US006197259B1

(12) United States Patent
Kelly et al.

(10) Patent No.: US 6,197,259 B1
(45) Date of Patent: Mar. 6, 2001

(54) EASY EJECT PIPETTE TIP

(75) Inventors: Christopher Kelly, Larkspur; James S. Petrek, Danville, both of CA (US)

(73) Assignee: Rainin Instrument Co., Inc., Emeryville, CA (US)

( * ) Notice: Subject to any disclaimer, the term of this patent is extended or adjusted under 35 U.S.C. 154(b) by 0 days.

(21) Appl. No.: 09/188,030

(22) Filed: Nov. 6, 1998

(51) Int. Cl.[7] ..... B01L 3/02
(52) U.S. Cl. ..... 422/100; 73/864.01; 73/864.14
(58) Field of Search ..... 422/99, 100; 73/864.01, 73/864.14

(56) References Cited

U.S. PATENT DOCUMENTS 3,646,817 * 3/1972 Hinchman et al. .
4,072,330 * 2/1978 Brysch .
4,748,859 * 6/1988 Magnussen, Jr. et al. .
4,961,350 * 10/1990 Tennstedt .
5,200,151 * 4/1993 Long .
5,355,738 * 10/1994 Heinonen .
5,660,797 * 8/1997 Jarvimaki .

* cited by examiner

*Primary Examiner*—Jan Ludlow
(74) *Attorney, Agent, or Firm*—Robert R. Meads

(57) ABSTRACT

A plastic pipette tip easily and firmly mountable on and easily ejectable from a pipette mounting shaft of a pipette by application of relatively small axial mounting and ejection forces of about six and three (3) pounds respectively. The pipette tip includes a tubular proximal portion comprising (i) a frusto-conical open upper end portion having an inner diameter at its upper end greater than the diameter of a mounting shaft of the pipette to which the pipette tip is to be mounted, (ii) a hollow mid-portion and (iii) an annular sealing region at a junction of the open end and mid-portions. The annular sealing region has an inner diameter less than "x" and is designed to engage a lower end of a sealing zone of the mounting shaft to stretch radially outward as the mounting shaft is guided and stably oriented in the proximal portion thereby creating a fluid tight seal between the sealing zone and the sealing region.

5 Claims, 3 Drawing Sheets

EASY EJECT PIPETTE TIP

BACKGROUND OF INVENTION

The present invention relates to improvements in disposable pipette tips for air displacement pipettes and, more particularly, to a pipette tip which is easily mounted in a physically stable fluid tight position on a pipette tip mounting shaft and which after use may be ejected from the mounting shaft by application of a relatively low axial tip ejection force.

The use of pipette devices for the transfer and dispensing of precise quantities of fluids in analytical systems is well known as is the use of disposable tip members for such pipettes. Disposable tips accommodate the serial use of such pipette devices in the transfer of different fluids without carryover or contamination.

Generally speaking, disposable pipette tips are formed of a plastic material and are of a hollow, elongated, generally conical shape with an open proximal end for receiving and releasably mating with the distal end of an elongated generally conical pipette tip mounting shaft of a pipette device. Ideally, the disposable tip should slide easily onto the mounting shaft to an axial position adjacent a lower end of a tip ejection mechanism of the pipette device. Thus located, the pipette tip should be laterally stable on the shaft, free from external rocking relative to the shaft (as during "touching off"), and should form a fluid tight annular seal with the mounting shaft. Then when it is desired to replace the tip with a new tip, the pipette tip should be easily removed from the mounting shaft by operation of the tip ejection mechanism.

To meet the desired sealing criteria for disposable pipette tips on pipette tip mounting shafts, the inner surface and side walls of the proximal portions of most pipette tips are axially tapered at a one to one and a half degree greater angle than the distal end of the pipette tip mounting shaft and form an axially elongated frusto-conical annular sealing band. The sealing band is dimensioned to stretch outwardly ("hoop stretch") as the distal end of the elongated generally conical pipette tip mounting shaft is forced into the proximal end of the tip to firmly seat the tip on the shaft and to create an axially elongated annular fluid tight seal between the sealing band and the mounting shaft. Other pipette tips, such as those described in U.S. Pat. No. 4,748,859, include a plurality of axially spaced compressible annular sealing rings on an inner surface of the proximal end portion of such tips. The rings create multiple axially spaced fluid tight annular seals between the outer surface of the pipette tip mounting shaft and the inner surface of the proximal end portion of the tip which by virtue of the axially spaced rings is laterally stabilized against undesired rocking on the shaft during touching off.

Usually, in mounting a pipette tip on a mounting shaft of a pipette, a user, exerting a downward force of between twelve and fifteen pounds, drives the mounting shaft axially into the tip a distance which to the user seems sufficient to create (i) a fluid tight seal between the tip and (ii) the desired lateral stability for the tip on the shaft. On occasion, in a mistaken attempt to improve the lateral stability of a pipette tip on a mounting shaft, a user will exert a downward insertion force (e.g. eighteen to twenty-five pounds) on the shaft sufficient to axially drive the tip on the shaft until an upper surface of the tip engages or is wedged into the ejector arm or cone of the tip ejector mechanism of the pipette. The contact between a lower surface of the tip ejector arm or cone and the upper surface of the tip, however, only provides a minimal resistance to rocking of the tip on the shaft and hence only results in a minimal increase in the lateral stability of the tip on the shaft. Further, since most pipette tips are formed of a relatively rigid plastic material, the annular stretching of the pipette tip required to accommodate movement of the tip onto the shaft particularly to a point where it engages the lower surface of the tip ejector or cone is difficult to achieve. In fact, the axial forces which must be exerted on a conventional pipette to achieve such a positioning of the tip on the pipette tip mounting shaft exceed twelve and may be as great as twenty pounds, which is difficult for many pipette tip users to generate. Of course, with most pipette tip designs, the greater the axial force exerted in seating a pipette tip on a pipette mounting shaft, the greater the force required to eject the tip from the mounting shaft. Thus, while the insertion of a pipette tip onto a mounting shaft until it reaches a position against a lower surface of a pipette tip ejector mechanism provides a minimum increase in the lateral stability of the tip on the shaft, it works against the design criteria for disposable pipette tips that they be easily removable from the shaft when it is desired to replace the tip.

In fact, the design criteria for disposable pipette tips that they be stably mountable on and form a fluid tight seal with a pipette mounting shaft is more easily achieved than the design criteria that disposable pipette tips slide easily onto a pipette tip mounting shaft to an axial location forming a fluid tight seal and then be easily removable from the mounting shaft when it is desired to replace the tip.

In these regards, the pipette tip mounting shafts of devices for pipetting volumes of liquid in different ranges have different external shape. For example, the distal end of standard pipette tip mounting shafts of pipettes for pipetting liquids in volumes greater than 500 microliters (large volume pipettes) commonly have a downward and inward axial taper of about one and one half to two and one half degrees per side from the longitudinal axis of the mounting shaft. On the other hand, the distal end of the mounting shafts of moderate to relatively small volume pipette devices (250 microliters and less) commonly have a downward and inward axial taper of about two to five degrees per side from the longitudinal axis of the mounting shaft so that the nose of the shaft will hit the inner wall of the pipette tip and cause hoop stretching thereof before the side of the shaft engages the inner wall of the tip. Therefore, while the design criteria that a large volume pipette tip be easily mountable on and easily removable from the mounting shaft of a large volume pipette device may be achieved by including a proximal end portion having a side wall of reduced wall thickness as in the large volume pipette tip described in U.S. Pat. No. 5,779,984, issued Jul. 14, 1998, such a thin wall design will not result in a pipette tip that satisfies the easy mount and ejection design criteria of moderate and small volume pipette tips which must firmly mount on pipette tip mounting shafts having an inward taper of two degrees and above. The same is true of the pipette tip design disclosed in U.S. Pat. No. 4,072,330 which includes a frusto-conical sealing region having a thin side wall.

As previously stated, standard small and moderate volume pipette tips include a frusto-conical annular sealing band or inner surface for engaging and sealing with the tapered distal end of a pipette tip mounting shaft. The angle of taper of the sealing surface usually approximates that of the mounting shaft (e.g. two to five degrees). Thinning the side wall of the standard small and moderate volume pipette tips in the region of such a sealing band does little to reduce the mounting and ejection forces required to move such a tip to a sealing location and then eject the pipette tip from the mounting shaft. In forming the desired annular seal, the frusto-conical annular region is required to stretch like a hoop (hoop stretch) outwardly normal to the mating sloping surface of the pipette tip mounting shaft. Large reactive forces in the tip material resist such hoop stretching and require the exertion of large axial forces (eg. ten or more pounds) on the tip in order to mount the tip on the mounting shaft and create the necessary annular fluid tight seal. Such reactive forces increase as the tip is driven toward the tip ejection mechanism of the associated pipette device.

Further, disposable pipette tips are commonly mounted and stored in sterilizable racks. Such racks commonly include a support tray having an array of holes for receiving distal ends of pipette tips to vertically orient the pipette tips in a spaced rectilinear pattern with open proximal ends of the tips exposed to receive the mounting shafts of a pipette device onto which the pipette tips are to be mounted. For example, to mount the disposable pipette tips contained in a tip rack on the shafts of a multi-channel pipette, the pipette device is placed over the rack with its several mounting shafts aligned with the open proximal ends of an aligned series of the pipette tips. After a slight initial insertion of the mounting shafts into the open proximal ends of the aligned pipette tips, a relatively large downward force is exerted on the pipette device to drive the mounting shafts into the tip members. The pipette tips are thus very firmly seated on the mounting shafts and are lifted from the rack with upward movement of the multi-channel pipette. Unfortunately, in practice, such multiple pipette tip mounting procedures often result in some of the pipette tips being mounted at different axial locations on some of the mounting shafts. In an attempt to eliminate such non-uniform mounting of pipette tips on the several channels of a multi channel pipette, users often rock the pipette as the mounting shafts are driven by axial forces approximating 12 to 15 pound per channel into the tips supported by a pipette tip rack to drive the tips toward the lower surface of the tip ejector mechanism of the pipette.

Moreover, the more firmly a tip is mounted or wedged on the mounting shaft of the pipette device, the greater the axial force which a pipette user must generate by thumb and hand action to eject the tip from the shaft when a tip replacement is desired. In practice, it is not uncommon for axial forces approximating ten pounds to be generated by the pipette users thumb and hand in driving a tip from a mounting shaft. Over several and repeated ejection operations, particularly with multi-channel pipettes where substantially greater axial ejection forces are required, the thumb and hand of the user become physically stressed often resulting in repetitive stress injury to the thumb and hand and in extreme cases, carpal tunnel syndrome.

Still further, standard pipette tips as well as those illustrated in U.S. Pat. No. 4,072,330 depend solely upon the sealing region of the pipette tip to both create the annular fluid tight seal and to provide the stable lateral mounting of the tip to the shaft sufficient to resist rocking as during touching off. The structure of such pipette tips do not provide such lateral mounting stability and but for those rare instances where the tips are jammed upward against the bottom of the pipette tip ejector arm or cone, minimal lateral stability of the tip on the shaft is achieved.

Accordingly, there is a need for an improved disposable pipette tip which will easily and stably mount on a pipette tip mounting shaft while creating a fluid tight seal and which may be subsequently ejected by a substantially reduced pipette tip ejection force. The present invention satisfies that need.

SUMMARY OF INVENTION

To meet the previously described ideal characteristics and criteria for a pipette tip, the present invention provides an improved plastic pipette tip easily and firmly mountable on and easily ejectable from a pipette mounting shaft of a pipette device by application of relatively small axial mounting and ejection forces, eg. less than three pounds. While the pipette tip of the present invention is useful with pipette devices having mounting shafts of various sizes and shapes, it is particularly useful with standard pipette tip mounting shafts having a distal end including an outer downwardly and inwardly tapering frusto conical annular sealing zone on its outer surface and having a diameter "x" at its lower end.

To meet the mountability and ease of ejection criteria for disposable pipette tips, the pipette tip of the present invention includes an open tubular proximal end portion comprising an enlarged frusto conical open top portion tapering downwardly and inwardly to join at an annular sealing region to a hollow substantially cylindrical mid-portion of the pipette tip, that is a portion where the axial taper is equal to or less than one and one half degrees from the vertical axis of the tip. The open top portion has an inner diameter greater than "x" for axially receiving the distal end of the mounting shaft while the axial taper of the open top portion exceeds the axial taper of the mounting shaft at the distal end so that the distal end will not engage the open top portion until the distal end engages the sealing region at the transition of the open top to mid portions of the pipette tip. The annular sealing region is formed by the transition or line of connection of the frusto conical open top portion to the mid-portion of the pipette and includes an annular sidewall having a thickness in a range of 0.20 to 0.50 mm. The mid-portion has an inner diameter less than "x" at the sealing region, a thin resilient annular side wall having a thickness in a range of 0.20 to 0.50 mm, and an axial length in a range of 0.25 to 0.65 cm. Thus, while the distal end of the mounting shaft fits into the enlarged open top portion of the pipette tip, the frusto conical outer surface of the mounting shaft engages the inner surface of the sealing region at the bottom of the open top portion of the pipette tip to stretch the annular sealing region or line radially outward as the mounting shaft is inserted into the proximal portion, thereby creating a fluid tight seal between the sealing zone and the sealing region.

In addition to the proximal portion, the pipette tip of the present invention includes a tubular distal portion extending from the mid-portion and terminating in a relatively narrow distal end opening for passing fluid into and from the tip upon operation of the pipette device.

Finally, the preferred pipette tip of the present invention includes lateral stabilizing means on an inner surface of the pipette tip adjacent the sealing region for engaging the outer surface of the mounting shaft as it is inserted into the proximal portion to laterally stabilize the tip on the shaft. Such lateral stabilizing means preferably comprises at least three circumferentially spaced contacts extending inwardly from the inner surface of the proximal portion of the tip adjacent the sealing region for engaging the outer surface of the mounting shaft as it is inserted into the proximal portion to laterally stabilize the tip on the shaft. In this regard, the diametric spacing of the contacts is such that the contacts lightly engage and allow the distal end of the shaft to pass with no hoop stretching of the sidewalls from which the contacts extend. In this manner, the contacts combine with the sealing region to provide lateral support for the pipette tip on the mounting shaft and prevent the pipette tip from moving laterally when lateral external forces are exerted on the distal portion of the tip as during touching off.

Thus, with the preferred pipette tip of the present invention, a mounting shaft of a pipette device is inserted into the open end of proximal portion of the tip. Such insertion is guided by the contacts engaging the outer surface of a distal end of the mounting shaft. Only when the lower end of the sealing zone of the mounting shaft engages the annular line or band of the sealing region is there any outward hoop stretching of the pipette tip. Such hoop stretching only occurs in the annular line or band defining the sealing region and in an adjacent substantially cylindrical thin side wall of the mid-portion as the sealing zone slides downward on the sealing region. Such contact and stretching presents a minimum and uniform resistance to axial motion of the mounting shaft into the proximal portion of the tip to create the desired fluid tight annular seal. While this is occurring, the contacts continue to guide the mounting shaft into the tip and being spaced from the sealing region stably orient and secure the tip on the mounting shaft. Also, while such guiding action is being provided, the side wall of the proximal portion supporting the contacts deforms and does not stretch thereby producing a minimum drag on the mounting shaft as it moves into the tip. This is accomplished by the pipette user exerting a minimal axial force on the pipette tip, eg. about three (3) pounds, and permits the tip to easily locate against the lower end of the ejection arm or cone if that is desired by the pipette user.

Then, when it is desired to eject the tip and replace it with another disposable tip, only a minimum axial force (less than three (3) pounds) need be exerted on the upper end of the tip by operation of the tip ejector to eject the tip from the mounting shaft. Thus, the mounting and ejection of the pipette tip of the present invention require a pipette user to generate so little hand and thumb force that repeated mounting and ejection of such tips is unlikely to result in repetitive stress injury.

DETAILED DESCRIPTION OF INVENTION

Figure 1:
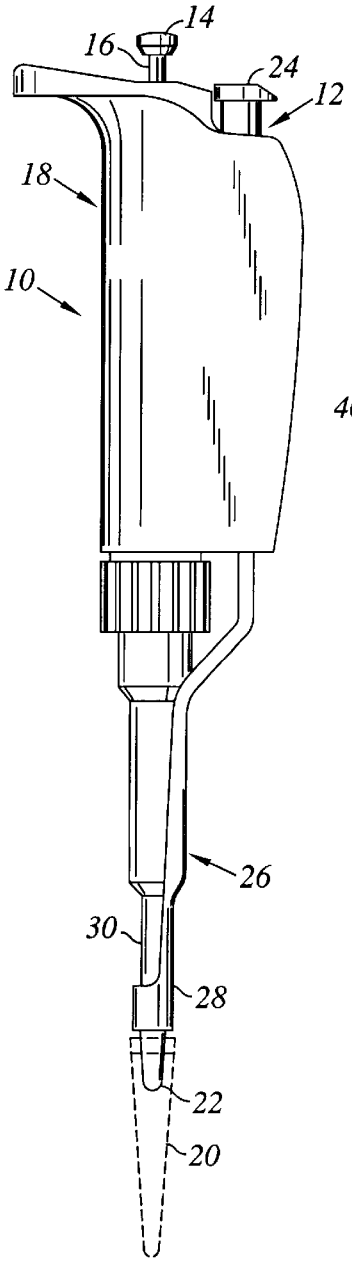
(PRIOR ART) Fig. 1
FIG. 1 is a side view of a standard manual pipette having a pipette tip mounted on a mounting shaft adjacent a lower end of a tip ejector mechanism of the pipette.

FIG. 1 illustrates a standard manual pipette resembling the PIPETMAN pipette sold exclusively in the United States by the Rainin Instrument Co. Inc., assignee of the present invention. The manual pipette is designated in FIG. 1 by the number 10 and includes a pipette tip ejector mechanism 12 described in U.S. Pat. No. 3,991,617 issued Nov. 16, 1976, which is incorporated herein by this reference.

The pipette 10 comprises a push button 14 connected by a rod 16 to a piston (not shown) located in the body or housing 18 of the pipette. The push button 14 may be depressed by a user exerting a downward force on the push button to cause downward movement of the piston of the pipette. When the push button 14 is released, a quantity of liquid to be sampled is sucked into a disposable pipette tip 20 releasably secured to a lower end of a pipette tip mounting shaft 22 of the pipette. The sample then may be transferred into another vessel by once more exerting a downward force on the push button 14. After such use, it is common practice to eject the pipette tip 20 from the mounting shaft 22 and replace it with a new pipette tip for repeated operation of the pipette 10 in aspirating and dispensing a new sample fluid.

The pipette tip ejection mechanism 12 is employed to eject the tip 20 from the mounting shaft 22. In this respect, the mechanism 12 comprises a push button 24 connected to a rod located in a passage (not shown) provided in an upper part of the hand holdable housing 18 of the pipette 10. The passage and rod are arranged so as to be able to impart to the rod a movement of translation parallel to an axis of the pipette in opposition to a spring (not shown) normally urging the rod in an upward position. A removable tip ejector member or arm 26 including a tubular upper end extends from a lower end of the rod and from the rod follows the general exterior contour of the housing 18 of the pipette to terminate in a sleeve 28. The sleeve 28 encircles a conical lower end 30 of the pipette housing 18 and the pipette tip mounting shaft 22 which tightly receives the upper end of the disposable pipette tip 20. To eject the pipette tip 20 from the lower end of the mounting shaft 22, a user grips the pipette housing 18 and using his or her thumb presses downward on the push button 24. The downward force on the push button is translated by the rod to the tip ejector arm 26 and hence to the sleeve 28 which presses down on an upper end of the pipette tip. When the downward force transferred by the sleeve 28 exceeds the friction between the pipette tip 20 and the mounting shaft 22, the pipette tip is propelled from the mounting shaft. Upon a release of the push button 24, the spring returns the tip ejector mechanism 12 to its normal position with the sleeve spaced slightly from the upper end of a replacement pipette tip which is inserted onto the mounting shaft 22 readying the pipette 10 for its next aspiration and dispensing operation.

Figure 3:
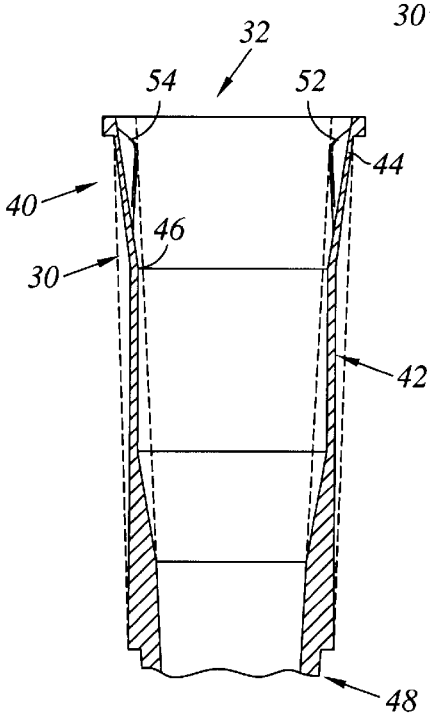
FIG. 3 is an enlarged fragmentary side view of an upper portion of the pipette tip of FIG. 2 shown in solid outline and overlying an upper portion of a standard 250 microliter pipette tip shown in dashed outline.

As previously stated, for standard small and moderate volume pipettes, the pipette tip mounting shaft 22 has an inward axial taper of between two and five degrees from the longitudinal axis of the mounting shaft. As also previously stated, standard small and moderate volume pipettes tips for use with such standard pipette tip mounting shafts include an frusto-conical annular sealing band or inner surface contiguous with the open proximal end of the tip for engaging and sealing with the tapered distal end of the pipette tip mounting shaft. The angle of taper of the sealing surface usually is within about one degree of the two to five degrees taper of the mounting shaft. In forming the desired annular seal, the frusto conical annular sealing region along with the balance of the open proximal end of the pipette tip is required to stretch like a hoop outwardly normal to the mating sloping surface of the pipette tip mounting shaft. The amount of plastic that is required to hoop stretch is depicted in FIG. 3 by the dashed outline of the proximal portion of a standard 250 microliter pipette tip. Large plastic forces in the tip material resist such outward hoop stretching and require exertion of large axial forces on the tip in order to mount the tip on the mounting shaft and create the necessary annular fluid tight seal. Often, axial forces approximating twelve to fifteen pounds are required to mount a standard pipette tip on a standard mounting shaft and create the desired fluid tight seal. Such axial forces are generated by the hand and forearm of a pipette user in inserting a pipette tip mounting shaft into a pipette tip usually held in a pipette tip mounting rack. Of course, when it is desired to eject such a firmly mounted tip from a pipette tip mounting shaft, an axial force of approximately ten (10) pounds must be exerted on the upper edge of the pipette tip to overcome the friction forces between the pipette tip and shaft and to eject the tip from the shaft. The relationship between tip insertion and tip ejection forces is depicted by the curve 60 in FIG. 7 for a standard 250 ml pipette tip, the tip insertion and ejection forces increasing from 0 to a point 62 where the tip engages an ejection mechanism of the associated pipette device. As previously described, the downward tip ejection forces are exerted by the pipette user pressing downward with his or her thumb on the top of the push button 24 to translate axial force through the ejector arm 26 to the top of the pipette tip 20. Over the course of several repeated ejection operations, the thumb and hand of the user will become physically stressed. This often results in repetitive stress injury to the thumb and hand and in extreme cases carpal tunnel syndrome.

Figure 7:
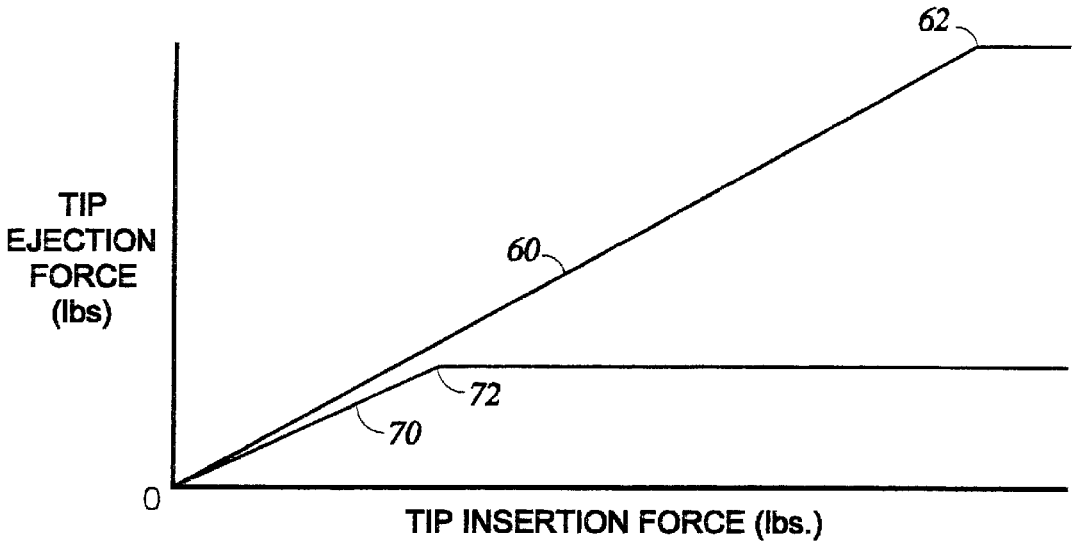
FIG. 7 is a graph comparing the forces required to insert and eject the pipette tip of the present invention onto and from a standard pipette tip mounting shaft with the insertion and injection forces for a standard pipette tip.

The present invention overcomes such problems by providing an improved pipette tip design which, as depicted by the curve 70 in FIG. 7, allows for the easy and firm mounting of a pipette tip on a mounting shaft and the easy ejection of the pipette tip from the mounting shaft by the application of minimal axial mounting and ejection forces, eg. an axial mounting force of approximately six pounds and an axial rejection force of about three pounds. In FIG. 7, the point 72 depicts the applied force necessary to insert and eject the tip of the present invention to and from a location on a pipette mounting shaft where the tip engages the tip ejection mechanism of an associated pipette. The substantial reduction in tip insertion and ejection forces associated with the pipette tip of the present invention when compared to those of a standard pipette tip is clear from a comparison of curve 70 to curve 60.

Figure 8:
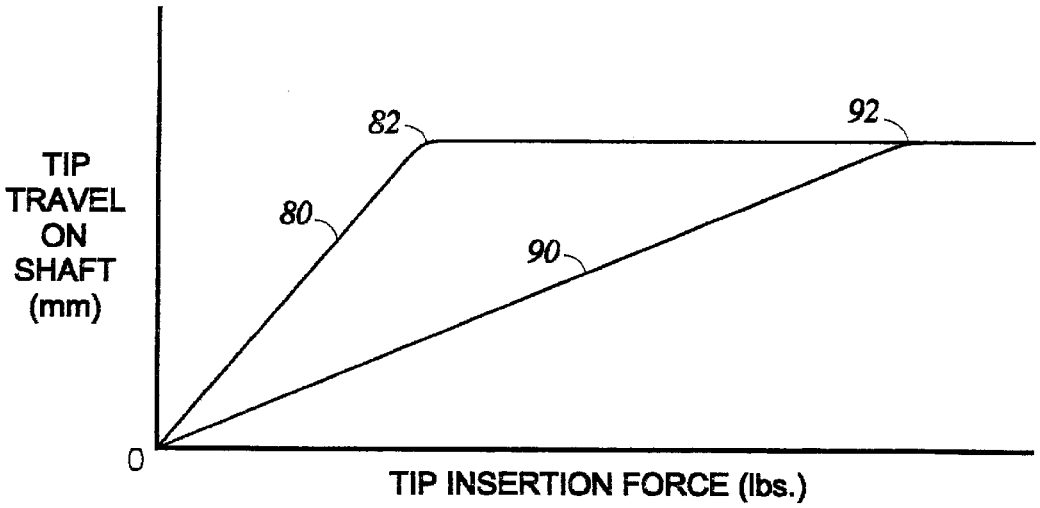
FIG. 8 is a graph comparing the pipette tip of the present invention with a standard pipette tip relative to pipette tip travel on a standard pipette mounting shaft in response to an insertion force applied to the pipette tip.

In FIG. 8, the relationship between the pipette tip insertion force and the distance traveled on the pipette tip mounting shaft is graphically depicted for the pipette tip of the present invention and a standard pipette tip. Curve 80 depicts the relationship between insertion force and pipette travel on the mounting shaft for the pipette tip of the present invention while the curve 90 depicts the relationship between the insertion force and the pipette tip travel on a mounting shaft for a standard pipette tip. In both instances, the travel of the pipette tip is limited by the pipette tip ejection mechanism engaging the pipette tip of the present invention or the standard pipette tip as depicted by points 82 and 92 respectively. The substantial increase in tip travel per unit of insertion force associated with the pipette tip of the present invention when compared to a standard pipette tip is clear from a comparison of curves 80 and 90.

Figure 2:
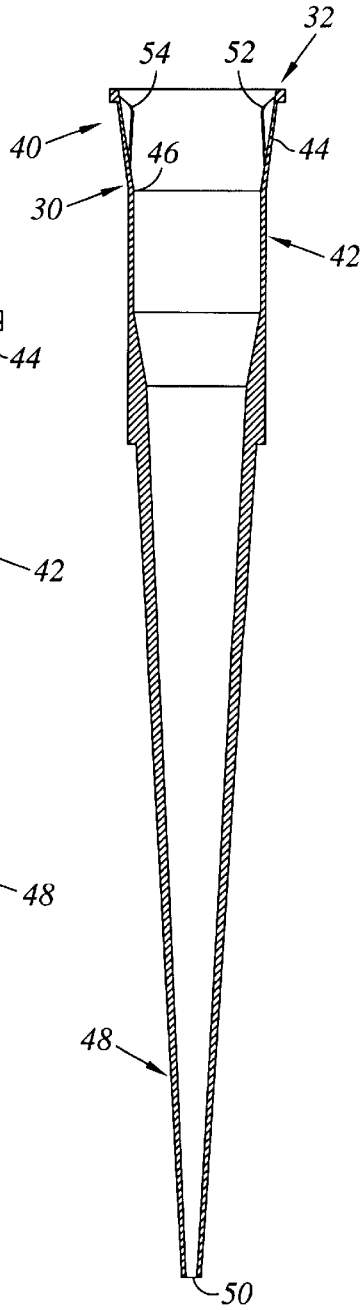
FIG. 2 is a cross sectional side view of one embodiment of the pipette tip of the present invention.

The structure of the tip of the present invention is compared to the structure of a standard 250 microliter pipette tip in FIG. 3 where the proximal portion 30 of a pipette tip 32, according to the present invention, is compared with a standard 250 microliter pipette tip shown in dashed outline. FIG. 2 shows in cross section the entire pipette tip 32 including the proximal portion 30.

Figure 4:
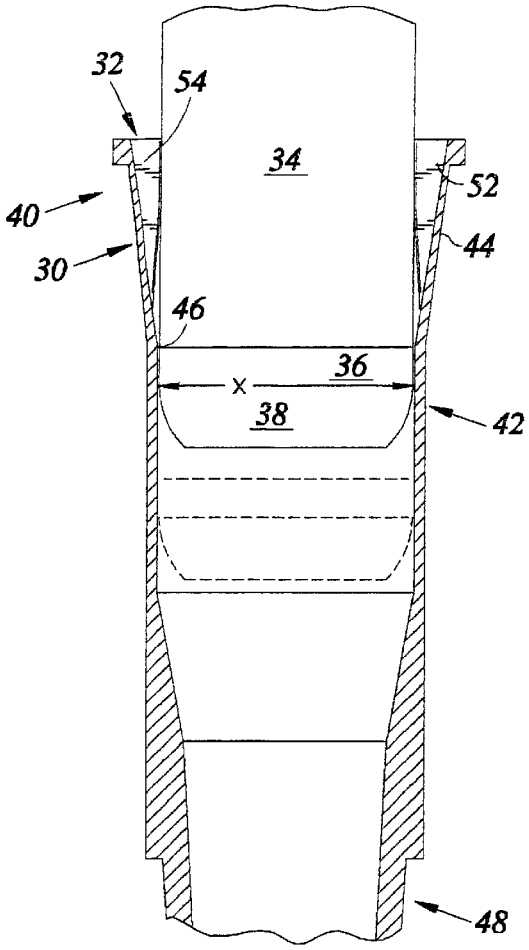
FIG. 4 is an enlarged fragmentary side view of an upper portion of the pipette tip of FIG. 2 showing the mounting shaft of a pipette inserted a first distance to a first position to create a fluid tight seal between a sealing zone on the mounting shaft and a sealing region of the pipette tip (shown in solid outline) and specifically showing, in dashed outline, the mounting shaft moved axially into the pipette tip a second distance to a second position.

While the pipette tip 32 is useful with pipettes having mounting shafts of various sizes and shapes it is particularly useful with standard pipette tip mounting shafts having a distal end including an outer axial inward tapering frusto-conical annular sealing zone on its outer surface which tapers at about five degrees and having a diameter "x" at its lower end as shown in FIG. 4. There, the mounting shaft 34 is shown as including an outer downwardly and inwardly tapering frusto-conical annular sealing zone 36 having a diameter "x" at its lower or distal end adjacent a tip end 38 of the mounting shaft 34.

More particularly, the pipette tip 32 of the present invention includes the proximal portion 30 which is of tubular construction having a frusto-conical open top portion 40 and a hollow substantially cylindrical mid-portion 42. The open top portion 40 has an inner diameter at its upper end greater than "x" for axially receiving the distal end of the mounting shaft 34 (FIG. 4). Also, while the axial taper of the open top portion 40 exceeds the axial taper of the mounting shaft at its distal end (e.g. greater than five degrees) so that the distal end will not engage the open top portion until it has engaged an annular sealing region 46 of the tip located at a junction or transition line of connection of the top and mid portions 40 and 42 of the tip. The side wall 44 of the open end portion 40 is thin having a thickness in a range of 0.20 to 0.50 mm. The mid-portion 42 has an axial length in a range of 0.25 to 0.65 cm and is contiguous with the open top portion 40. As previously stated, at the junction or transition between the open top portion 40 and mid portion 42 the side wall of the tip forms the annular sealing line or band region 46 having an inner diameter less than "x" and a thin and resilient annular side wall which like the mid-portion 42 has a thickness in a range of 0.20 to 0.50 mm. The sealing region 46 is designed to engage a lower end of the sealing zone 36 on the mounting shaft 34 and to stretch radially outward as the mounting shaft is inserted into the proximal portion 30 thereby creating a fluid tight seal between the sealing zone and the sealing region.

As shown in FIG. 2, in addition to the proximal portion 30, pipette tip 32 of the present invention includes a tubular distal portion 48 extending from the proximal portion 30 and terminating in a relatively narrow distal end opening 50 for passing fluid into and from the tip 32 upon operation of the pipette to which the pipette tip is attached, such as the pipette 10 illustrated in FIG. 1.

Figure 5:
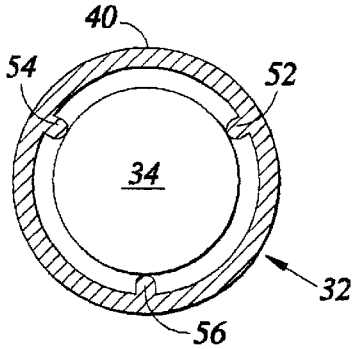
FIG. 5 is a top view of the pipette tip illustrated in FIG. 4 showing the structure and shape of the pipette tip when the pipette tip mounting shaft is at the first position creating a fluid tight seal between the sealing zone and the sealing region.

Finally, the preferred version of the pipette tip 32 of the present invention includes lateral stabilizing means extending from the inside of the pipette tip adjacent the sealing region 46. Preferably, such stabilizing means comprises at least three (3) circumferentially spaced contacts 52, 54 and 56 (see FIG. 5) extending inwardly from the inner surface of the proximal portion 30 of the tip 32 preferably between the sealing region 46 and the upper proximal end of the tip. The contacts 52, 54 and 56 are adjacent the sealing region 46 and are equally spaced from each other. Further, the innermost surfaces of the contacts, illustrated as comprising longitudinally extending lobes, define three regions on a cylinder coaxial with the tip and having a diameter of approximately "x". Thus, the innermost surfaces of the contacts 52, 54 and 56 are designed to engage longitudinally extending circumferentially spaced outer surfaces of the mounting shaft 34 as it is inserted into the proximal portion 30 to laterally stabilize the tip 32 on the shaft. Such spacing of the contacts allows the distal end of the mounting shaft to pass into the proximal portion 30 of the tip 32 without causing the side walls from which the contacts extend to stretch outwardly, as most clearly shown in FIG. 5. In this manner, the contacts 52, 54 and 56 combine with the sealing region 46 as it mates with the sealing zone 36 on the mounting shaft 34 to (i) provide lateral support for the pipette tip 32 on the mounting shaft and (ii) prevent the pipette tip from moving laterally when lateral external forces are exerted on the distal portion of the tip as during touching off.

Figure 6:
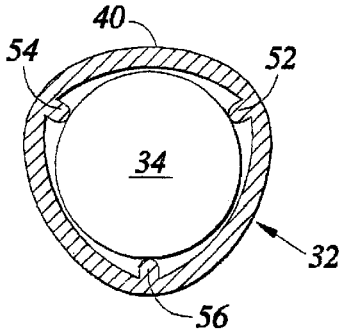
FIG. 6 is a top view similar to FIG. 5 for the pipette tip of FIG. 4 with the mounting shaft moved to the second position shown in dashed outline in FIG. 4.

Thus, with the pipette tip 32 of the present invention, as the mounting shaft 34 of the pipette device 10 is inserted into the open end 40 of the proximal portion 32 of the tip, such insertion is guided by the contacts 52, 54, and 56 engaging the outer surface of the distal end of the mounting shaft. Only when the lower end of the sealing zone 36 of the mounting shaft 34 engages the sealing region 46 of the pipette tip is there any outward hoop stretching of the pipette tip. Such hoop stretching is limited to the cylindrical thin side walls of the mid-portion 42 of the pipette tip 32 at and immediately adjacent the sealing region. This presents a minimum and a uniform resistance to further axial motion of the mounting shaft 34 into the proximal portion 30 of the tip 32 to create the desired fluid tight annular seal. While this is occurring, the contacts 52, 54 and 56 continue to guide tip 32 onto the mounting shaft 34 and stably orient and secure the tip on the mounting shaft. Also, while such guiding action is being provided, the side wall of the proximal portion 32 supporting the contacts 52, 54 and 56 deforms rather than hoop stretching, as shown in FIG. 6, thereby producing a minimum drag on the mounting shaft as it moves into the tip.

Such mounting and orientation of the tip on the mounting shaft and the creation of the desired fluid tight seal is accomplished by a pipette user exerting less than about six pounds of axial force on the pipette and permits the tip to easily locate against the sleeve 28 or shelf at the lower end of the ejection arm 26, to further improve the lateral stability of the tip on the shaft.

Then, when it is desired to eject the tip and replace it with another disposable tip 32, only a minimum axial force, e.g. less than about three pounds, need be exerted on the upper end of the tip by operation of the tip ejector 12 as previously described to eject the tip from the mounting shaft 34. Thus, the mounting and ejecting of the pipette tip of the present invention require a pipette user to generate so little hand and thumb force that repeated mounting and ejection of such tips will substantially reduce the chances of repetitive stress injury.

Figure 9:
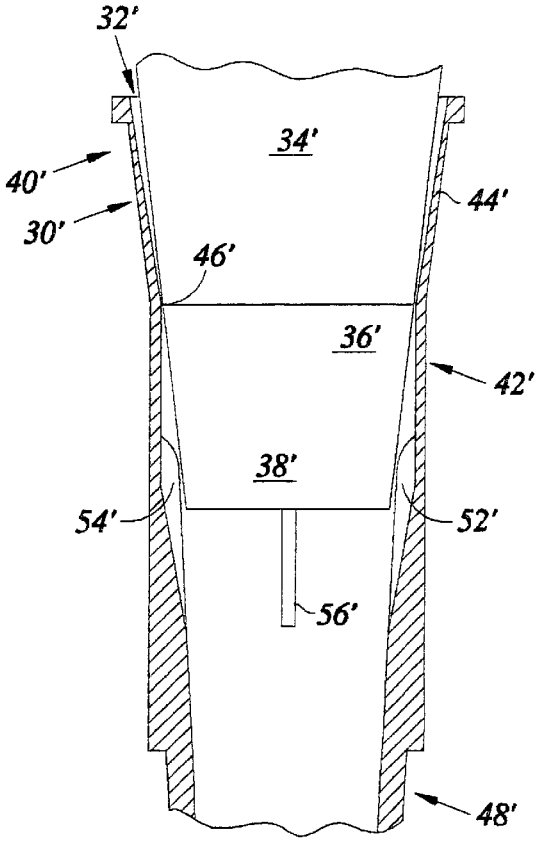
FIG. 9 is an enlarged fragmentary sectional side view of a second embodiment of the pipette tip of the present invention mounted on a standard mounting shaft of a pipette device.

While in the foregoing, particular preferred embodiments of the pipette tip of the present invention have been described and illustrated in detail, changes and modifications may be made without departing from the spirit of the present invention. For example, in the embodiment of the present invention illustrated in FIGS. 3 and 4, the contacts 52, 54 and 56 are located above the sealing region 46 and extend inwardly from the sidewalls comprising the frusto conical open upper end of the tip. FIG. 9 depicts an alternate version of the present invention wherein the contacts 52', 54' and 56' extend from inner walls of the mid-portion 42' of the pipette tip 32' to engage outer surfaces of the pipette mounting shaft 34' as the sealing band 36' of the shaft 34' engages the sealing region 46' of the pipette tip. In all physical and functional respects, the contacts 52, 54' and 56' function in the same manner as the previously described contacts 52, 54 and 56. Accordingly, the present invention is to be limited in scope only by the terms in the following claims.

What is claimed is:

1. An improved pippette device comprising a plastic pipette tip mountable on and ejectable from a pipette tip mounting shaft by application of axial mounting and ejection forces of less than three pounds:

the pipette tip mounting shaft comprising:

a distal end portion including an axially inwardly tapering sealing zone and a diameter "x" at its distal end; and the pipette tip comprising:

a tubular proximal portion comprising (i) a frusto conical open top portion having an inner diameter greater than "x" at its upper open end for axially receiving the distal end of the mounting shaft and having a sidewall tapering downwardly and axially inwardly at an angle greater than the axial taper of the mounting shaft so that the distal end of the mounting shaft will engage a lower open end of the open top portion prior to the inwardly tapering sealing zone engaging the sidewall of the open top portion, (ii) a hollow mid-portion having a substantially cylindrical sidewall extending from the lower open end of the sidewall of the open top portion and (iii) an annular sealing region comprising an inwardly facing annular line seal formed by a junction of the sidewalls of the downwardly and inwardly tapering open top portion and the substantially cylindrical mid-portion and having an inner diameter less than x so as to engage the distal end of the sealing zone of the mounting shaft as the mounting shaft is inserted into the proximal portion of the pipette tip, the sidewalls of the open top and mid-portions in the annular sealing region being sufficiently thin that the annular line seal will expand and form a fluid tight seal with the sealing zone of the mounting shaft as the sealing zone penetrates the sealing region;

a tubular distal portion extending from the mid-portion and terminating in a distal end opening for passing fluid into and from the tip upon operation of the pipette device; and circumferentially spaced lateral stabilizing contacts extending from an inside surface of the sidewall of the pipette tip adjacent the sealing region and defining regions on a cylinder having an inner diameter equal to or less than "x" and the sidewall of the pipette tip from which the contacts extend being sufficiency thin to deform between the contacts as the contacts engage an outer surface of the mounting shaft as it is inserted into pipette tip to laterally stabilize the tip on the shaft.

2. The pipette tip of claim 1 wherein the mid-portion at and adjacent the sealing region includes a sidewall having a thickness between 0.20 and 0.50 mm.

3. The pipette tip of claim 1 wherein the contacts are between the sealing region and the open top of the proximal portion.

4. The pipette tip of claim 1 wherein the contacts are between the sealing region and the distal portion of the tip.

5. The pipette tip of claim 1 wherein the contacts comprise at least three lobes extending from the inner surface of the proximal portion.

* * * * *